US009206486B2

(12) United States Patent
Renner et al.

(10) Patent No.: US 9,206,486 B2
(45) Date of Patent: Dec. 8, 2015

(54) METHOD FOR TANNING ANIMAL SKINS

(75) Inventors: Manfred Renner, Essen (DE); Eckhard Weidner, Bochum (DE); Helmut Geihsler, Cologne (DE)

(73) Assignee: Fraunhofer-Gesellschaft Zur Foerderung Der Angewandten Forschung E.V., Munich (DE)

( * ) Notice: Subject to any disclaimer, the term of this patent is extended or adjusted under 35 U.S.C. 154(b) by 0 days.

(21) Appl. No.: 13/380,803

(22) PCT Filed: Apr. 21, 2010

(86) PCT No.: PCT/EP2010/002452

§ 371 (c)(1),
(2), (4) Date: Dec. 23, 2011

(87) PCT Pub. No.: WO2010/121804

PCT Pub. Date: Oct. 28, 2010

(65) Prior Publication Data

US 2012/0144597 A1 Jun. 14, 2012

(30) Foreign Application Priority Data

Apr. 21, 2009 (DE) ..... 10 2009 018 232

(51) Int. Cl.

| | |
|---|---|
| ***C14C 3/06*** | (2006.01) |
| ***C14C 3/10*** | (2006.01) |
| ***C14C 3/30*** | (2006.01) |
| ***C14C 1/00*** | (2006.01) |

(52) U.S. Cl.

CPC ... *C14C 3/06* (2013.01); *C14C 3/10* (2013.01); *C14C 3/30* (2013.01)

(58) Field of Classification Search

CPC ..... C14C 1/06; C14C 3/00; C14C 9/02; C12B 1/00; C08F 220/06; C08F 220/28

USPC ..... 8/94.14, 94.18, 94.19, 94.21, 128.1

See application file for complete search history.

(56) References Cited

U.S. PATENT DOCUMENTS

| | | | | |
|---|---|---|---|---|
| 3,840,433 | A * | 10/1974 | Aunstrup et al. | 435/265 |
| 4,312,632 | A | 1/1982 | Torrini | |
| 5,300,121 | A * | 4/1994 | Gordon et al. | 8/94.14 |
| 5,900,027 | A | 5/1999 | Geihsler et al. | |
| 6,854,301 | B1 * | 2/2005 | Romanski | 69/48 |

FOREIGN PATENT DOCUMENTS

| | | | |
|---|---|---|---|
| CN | 1673394 | A | 9/2005 |
| DE | 195 07 572 | A1 | 9/1996 |
| DE | 10 2006 008190 | A1 | 8/2007 |
| FR | 2800389 | A1 | 5/2001 |
| WO | WO 0131067 | * | 5/2001 |

OTHER PUBLICATIONS

WIPO translation of WO 2001031067. pp. 1-7. 2001.*

Derwent Acc No. 2001-343346, English Abstract of WO 0131067. pp. 1-2. 2001.*

International Search Report for Appln. No. PCT/EP2010/002452 mailed Jul. 27, 2010.

Chinese Office Action issued in corresponding application No. 2010800175044 on Mar. 13, 2013, English portion only.

* cited by examiner

*Primary Examiner* — Gregory R Delcotto

*Assistant Examiner* — Preeti Kumar

(74) *Attorney, Agent, or Firm* — Carter, DeLuca, Farrell & Schmidt, LLP

(57) ABSTRACT

The present invention relates to a process for tanning animal hides which comprises the steps of:

bating and pickling the animal hide in aqueous solution, reducing the liquid content of the animal hide, replacing at least some of the liquid removed from the animal hide in the preceding step by a tanning solution which contains the tanning agent to be imbibed by the animal hide in an amount not exceeding an excess of 80%, and treating the animal hide containing the tanning solution with compressed gas in a pressurized container for a period of at least 15 minutes.

Such a process is substantially wastewaterless, optionally even completely wastewaterless, and delivers high-quality through-tanned leathers or furs after short treatment times.

13 Claims, No Drawings

METHOD FOR TANNING ANIMAL SKINS

The present invention relates to a process for tanning animal hides. The term "animal hide" includes hides and skins of animal origin, for example cattle, goat, sheep, buffalo, etc.

The conventional production of ready-to-use leathers or furs parses into processing steps taking place in the beamhouse, and the subsequent finishing of the leather or fur. Beamhouse operations in turn subdivide into soaking, unhairing (liming), hide opening, first washing operation, deliming, bating, second washing operation, pickling and finally tanning. Some fundamental steps will now be described in more detail.

Soaking frees the raw material of dirt and preserving salt and returns it to its original water content. Soaking takes place at a pH between 7 and 9. Water-soluble proteins are removed in the process. In the liming step, sulphur compounds as well as lime are added to loosen the hair off the hide and destroy the highly water- and fat-containing epidermis. The proteins are hydrolized, i.e. rendered water-soluble, and washed off. At the same time, the lime and sulphur compounds used in the liming step, which have a powerful reducing effect, attack and rupture the polypeptide chains of the leather hide. This leads to greater mobility of the fibers, which endows the leather with enhanced extensibility and softness. This operation is also known as hide opening. During the entire liming operation, the hide undergoes a process of swelling due to becoming highly anionically charged and the attendant repellence between groups bearing the same charge.

In the fleshing step, remnants of tissue, flesh and fat are removed using sharp bladed rolls. To obtain uniformly thick leather in a desired thickness, the hide is split. Fleshing and splitting is performed individually for each hide by hand and machine combined. The untanned leather hide is known as a pelt. A pelt has a water content of about 60 to about 80%. The dry matter is about 98% collagen.

Bating and pickling are used to remove the last remnants of surficial protein in the hide. The swelling induced in liming by the high alkalinity has to be eliminated before tanning in order that the tanning agents may penetrate into the fibrillar interstices of the hide fiber fabric. This is achieved in bating by adding weak organic acids, for example aliphatic or aromatic dicarboxylic acids such as, for instance, sulphophthalic acid, or by adding weakly acidic inorganic salts, for example ammonium sulphate, ammonium chloride or polyphosphates.

In deliming, the calcium hydroxide in the hide is removed. Optionally, the hide can be further opened up using enzymes. Deliming and bating are performed in a somewhat heated float, i.e. at about 30 to 35° C. The bating and pickling operation takes about 8 to 24 hours at pH 2.5. The hide obtained after bating and pickling is fully saturated with aqueous solution and is known as a pickled pelt.

At this point the actual tanning is carried out, conventionally taking 12 to 48 hours. The float ratio between the mass of tanning solution and the mass of pickled pelt to be tanned (i.e. the mass of hides fully saturated with aqueous solution) is between 8:1 and 1:1, although typically an excess of tanning solution is used. The tanning operation is frequently carried out in rolling drums and is then known as drum tannage. In addition to water and tanning agent, the tanning liquor contains, for example, salt, formic acid, sulphuric acid, sodium bicarbonate and further added substances. During tanning, the bonding-capable groups on the collagens undergo crosslinking with the tanning agents. The pH is raised to values between 3.6 and 4, by addition of alkali, in contradistinction to the bating and pickling operation.

On conclusion of the tanning operation, the tanning solution left over, i.e. not imbibed by the leather or fur to be tanned, represents wastewater which has to be disposed of. Tanning alone generates 160 to 200 million tonnes of wastewater worldwide. This wastewater has a considerable adverse impact on the environment unless it is cleaned up in a suitable manner. Tanning wastewater is customarily cleaned up in several stages, first for example by means of decanters to remove solids and then in a biotreatment stage. Wastewater cleaning is always time-consuming and costly and therefore is often not done in third world countries and threshold countries in particular. Instead, the wastewater is discharged dirty into rivers or lakes, where it leads to severe environmental damage.

After tanning, the tanning liquid adhering within and to the hides is removed from the hides using mechanical processes (known as samming). The as-sammed hides are known as wet blues if chrome tanned, as wet browns if vegetable tanned and as wet whites if aluminium tanned. The acid from tanning is neutralized and then the leather is assembled into lots for dyeing. This is followed, depending on the type of leather, by a filling operation and a dyeing operation with water-soluble dyes for example. A subsequent addition of fatliquors finally provides the softness required of the final leather. Lastly, the leather is dried, for example by vacuum drying or suspension drying.

From the above, it would be clearly very desirable to achieve a distinct reduction in the amount of wastewater generated in tanning in particular or even to eliminate the generation of wastewater entirely. There have already been various approaches in that direction. DE 195 07 572 A1 for instance describes a process for finishing animal hides or skins which includes a treatment of the hides or skins with an aqueous solution in which carbon dioxide has been dissolved under pressure. The aqueous solution can be a conventional tanning solution. The float ratio is in the range from 4:1 to 1:1. Although this process will provide a saving in the amount of water used and also a shortening in the requisite dyeing time compared with traditional processes, it does still generate about two tonnes of wastewater per tonne of treated leather or fur.

DE 30 27 637 A1 describes a drum tanning process wherein a substantially reduced amount of liquid is used in tanning. Tanning is effected by contacting moist hides with dry powder of chromium. The chrome tanning thus effected is stated therein to have the same outcome as a conventionally performed chrome tanning. The tanning time is 6 hours, but the tanned hides still have to rest for 48 hours at least before the subsequent finishing operation. The inventors of the present application have treated leather according to the teaching given in DE 30 27 637 A1. The leather obtained was of poor and absolutely uncommercial quality. The leather obtained had undergone what is known in the tanning industry as "case-hardening", where tanning is merely surficial, evidently due to the low amount of highly concentrated tanning solution. In addition, the skin layer of the leather became detached in some cases, which is known as "loose grain".

DE 10 2006 008 190 A1 describes a process for fatliquoring leather wherein the animal hide to be treated initially has an oil, fat or polymer applied to it, by spraying for example, and is subsequently treated in a compressed gas in order that the applied oil, fat, etc. may be efficiently distributed and excess oil, fat, etc. removed. U.S. Pat. No. 5,512,058 describes a similar process.

To achieve the abovementioned object, the present invention provides the novel tanning process recited in claim 1, wherein the animal hide to be treated is initially bated and pickled in aqueous solution, then the liquid content of the animal hide is reduced, whereupon at least some of the liquid quantity previously removed from the animal hide is replaced by a tanning solution which contains the tanning agent to be imbibed by the animal hide in an amount which corresponds at most to an excess of 80%, and finally the animal hide containing the tanning solution is treated with compressed gas for at least 15 minutes in a pressurized container. By "treating" herein is generally meant the contacting of the animal hide containing the tanning solution with the compressed gas. The tanning agent quantity to be imbibed by the animal hide depends on the tanning agent percentage desired in the tanned ready-to-use animal hide in order to obtain the desired leather quality, verifiable via the shrinkage temperature of the ready-treated leather.

The process according to the present invention therefore preferably comprises adding as much liquid in the tanning step as the liquid content reduction step previously removed from the animal hide to be treated. This ensures that the entire amount of liquid added can be imbibed by the animal hide to be treated. There accordingly is no excess of (tanning) solution in the pressurized container. Yet despite the thereby resulting very low float ratios of less than 1, the process according to the present invention surprisingly yields leathers and furs meeting the highest requirements, i.e. the leathers or furs obtained are outstandingly deep-tanned despite minimal or even no wastewater being generated. A further advantage of the process according to the present invention is a distinctly shortened treatment time compared with conventional processes.

The hides obtained after the bating and pickling step typically contain about 70% to 75% by weight of liquid, based on their total weight (dry hide plus liquid). The reducing step reduces the liquid content of the animal hide by from 5% to 90%, preferably by from 20% to 70% and more preferably by from 30% to 50%. In one preferred embodiment of the process according to the present invention, the fully saturated animal hide has about half the liquid it contains removed from it. Any method which is suitable can be used for reducing the liquid content of the animal hide. Thermal, adsorptive or mechanical processes can be used as well as any desired combination thereof. One preferred embodiment utilizes a mechanical squeezing process whereby the desired amount of liquid is expressed from the animal hide.

As mentioned, at least some of the liquid removed from the animal hide in the reducing step is replaced by a tanning solution which the liquid-reduced animal hide ideally imbibes completely. To achieve this, float ratios having a small value are advantageous. The float ratio should preferably be not more than 2 and more preferably it has a value below 1, i.e. the mass of tanning solution added is at most equal to the amount of liquid removed and always smaller than the mass of the s animal hide as obtained from the bating and pickling step, fully saturated with aqueous solution. The float ratio in such a case preferably assumes values of from 0.05 to 0.9, while it is more preferable for the float ratio value to be in the range from 0.1 to 0.7 and more preferably in the range from 0.3 to 0.6. The tanning solution can be added by spraying for example, but also by dipping the animal hide into a corresponding amount of tanning solution.

The tanning solution added may contain vegetable and/or synthetic tanning agents. In one embodiment, the tanning solution contains tanning agents comprising metal cations, for example salts of chromium or of aluminium. The tanning solution may further contain added substances to confer certain desired properties on the animal hide to be treated. Such added substances can be dyes, adhesives, moisture-regulating preparations, flame retardants, microparticles, nanoparticles, emulsifiers, emulsions, hydrophobicizers, lipophilizers, brighteners, fats, train oils or oils and also a suitable combination thereof.

The tanning agent content of the tanning solution added is preferably determined according to the present invention such that it approximately corresponds to the tanning agent content which the animal hide to be treated is to imbibe in order that good quality of leather may be obtained. Those skilled in the art here aim for a 4 weight per cent tanning agent content, based on the ready-to-use leather. Leathers having such a tanning agent content have shrinkage temperatures of around 95 degrees Celsius. Provided one is prepared to accept certain sacrifices in relation to shrinkage temperature, i.e. to be content with lower shrinkage temperatures, tanning agent contents of 3% by weight can also lead to tolerable qualities of leather. Sometimes, a certain excess of tanning agent can be beneficial. The excess in tanning agent content can accordingly be up to about 80%, but preferably it is at most 20%. Hence, altogether, the excess of tanning agent is appreciably below that employed in the conventional procedure. With the process according to the present invention it is accordingly the case that the tanning agent in the tanning solution (in the float) passes almost completely into the animal hide treated. This ensures that the animal hide to be treated receives that amount of tanning agent needed for complete tanning and avoids significant amounts of unconsumed tanning agent having to be aftertreated.

The period for which the animal hide containing the tanning solution is treated with compressed gas under pressure in a pressurized container is preferably in the range from 30 minutes to 30 hours and more preferably in the range from 1 to 3 hours.

The pressure in the pressurized-treatment step can be in the range from 10 bar to 200 bar, preferably in the range from 15 bar to 100 bar and more preferably in the range from 20 bar to 60 bar.

The temperature in the pressurized-treatment step can be in the range from 0° C. to 80° C., preferably in the range from 10° C. to 60° C. and more preferably in the range from 25° C. to 40° C.

Particularly carbon dioxide and nitrogen and also mixtures thereof are useful as compressed gas. The animal hides are preferably agitated during the pressurized treatment step in order that uniform tanning may be obtained.

Following the pressurized treatment, the treated animal hides can be removed from the pressurized container and finished in a conventional manner. The liquid in the pressure-treated animal hides can be removed mechanically or thermally. If the removed liquid is recovered, which is a simple possibility in the case of thermal removal and drying for example, it can be returned into the process, making the tanning step fully wastewaterless.

When carbon dioxide is used as compressed gas, a further advantage results for the process according to the present invention. As explained, the typical post-bating and pickling pH of 2.5 normally has to be raised in the tanning step by addition of alkalis, or the hide structure is destroyed by what is known as acid swelling. The compressed carbon dioxide dissolves in the tanning solution and causes the pH to rise to a value where acid swelling is avoided without the need to add alkalis. According to the present invention, when carbon dioxide is used as compressed gas, it is accordingly sufficient for the tanning solution to contain merely water, tanning agent and salt.

In one embodiment of the process according to the present invention, the bating and pickling step is also carried out in a pressurized container in the presence of a compressed gas, which is preferably carbon dioxide, but can also be, for example, nitrogen or a mixture of $CO_2$ and $N_2$. As mentioned, the carbon dioxide dissolved in the liquid phase is effective in raising the pH to about 3.3, eliminating the need for the otherwise customary buffering of the pH by added alkalis. In this way, the process according to the invention makes it possible to achieve a further saving in chemicals. The degree to which the carbon dioxide dissolves in the liquid phase can be controlled via the pressure in the pressurized container in that a higher pressure will cause more carbon dioxide to dissolve.

In sum, the process according to the present invention incorporates into the animal hide that amount of tanning chemicals which is required for quality tanning. At the same time, the tanning process is shortened to a few hours and deep tanning is achieved at float ratios far below the values hitherto considered technically realizable. Customarily used chemicals for setting the pH can optionally be replaced, wholly or partly, by carbon dioxide and/or nitrogen to distinctly reduce the environmental impact.

The process according to the present invention will now be further elucidated in several exemplary embodiments and also comparative tests.

EXAMPLE 1

A raw hide (pickled pelt from the cow) having a weight of 1000 g was mechanically sammed. Hide weight after this operation was 600 g. The hide was then contacted with 400 g of tanning solution. The hide had imbibed the 400 g of solution after about one hour. After this step, the hide was treated with carbon dioxide for 2 hours in an autoclave at 30 bar and 40° C. The basket holding the hide in the autoclave rotated at a speed of 10 revolutions per minute. After the process, the tanned hide was finished. Not only the determination of the chromium content (4.2% of $Cr_2O_3$) but also the determination of the shrinkage temperature ($T_S$>95° C.), the tensile strength (30 N/mm$^2$), the pH of the finished leather (3.7) and the tongue tear strength (50 N/mm$^2$) revealed a high quality of leather.

The tanning solution consisted of 310 g of water, 65 g of chromium sulphate and 25 g of salt. The calculation of the minimum amount of chromium sulphate to be used is recited by way of example. The pH was adjusted to 3.6 with sodium carbonate. What follows is an illustrative calculation of the necessary tanning-chemical quantity for an overdosage of 80%.

The hide fraction in the wet blue is 35% by weight on average. Given a target content of 4% by weight, at least 14 g of chromium oxide have to be added to 1 kg of wet blue.

This corresponds, given $M(Cr_2O_3)$=152 g/mol, M(Cr)=52 g/mol and M(O)=16 g/mol, to a value of 9.58 g of chromium (III) ions which the float must contain at a minimum. Based on 400 g of float, the use of chromium sulphate as tanning agent results in $M(Cr_2(SO_4)_3)$=392 g/mol, M(S)=32 g/mol, M(Cr)=52 g/mol, M(O)=16 g/mol→26.53% of chromium in chromium sulphate.

It is accordingly necessary to dissolve altogether at least 100%/26.53%*9.58 g=36.11 g $Cr_2(SO_4)_3$ in 400 g of float to ensure an amount of chromium needed for good quality of leather. In Example 1, about 1.8 times the amount of chromium sulphate was dissolved in the float, i.e. about 65 g.

It was noted that the ability of the hide to imbibe chromium appears to be increased in gas-assisted tanning. Therefore, a certain overdosage of chromium can be advantageous. Tests have shown that a 10 to 20 per cent overdosage leads to an optimum success in tanning.

EXAMPLE 2

The procedure and all parameter settings of Example 1 will also be used for Example 2 (samming from 1000 g to 600 g with subsequent tanning agent imbibition by dipping and imbibition of 400 g). Only the step of adjusting the tanning solution pH with alkalis was omitted. After the hide was immersed for one hour at pH 2.5, then allowed to drip off and subsequently treated with compressed carbon dioxide at 30 bar, 40° C. for 2 hours, it was found to have a chromium content of >4% of $Cr_2O_3$. Shrinkage temperature was $T_S$>95° C. coupled with very good tensile strength of 40 N/mm$^2$.

EXAMPLE 3

A cattle hide weighing 1.5 kg was prepared for tanning by the insertion method described in Example 1. Sammed, it subsequently imbibed 600 g of tanning solution. The process is the same as that carried out in Example 1 except that a pressure of 20 bar was set in the autoclave. Both the shrinkage temperature ($T_S$<90° C.) and the tensile strength (14 N/mm$^2$) showed that the leather was not tanned through.

EXAMPLE 4

A cattle hide having a wet weight of 1.2 kg was sammed (480 g) and dipped by the method described in Example 1. The hide was subsequently agitated for 2.5 h under atmospheric pressure and left to rest for more than 24 h after the experiment. This hide was not tanned through. Visually and haptically, a horn-like dryness of the untanned collagen of the hide was noted after finishing.

EXAMPLE 5

The procedure described in the DE 30 27 637 A1 patent was carried out. Pickled pelts had 7% of chromium sulphate and 0.6% of sodium carbonate applied to them as a dry powder. The hide was subsequently agitated for 5 h, followed by a resting time of 72 h. A horn-like dryness was noted after finishing.

EXAMPLE 6

The procedure, parameters and mass ratios chosen in Example 2 were used. The wet weight of the hide was 3.5 kg. Sammed, 1400 g were imbibed. The leather likewise has a shrinkage temperature of $T_S$>90° C. and the optical and haptic analysis of the finished leather showed high quality of leather.

EXAMPLE 7

The parameters used in Example 1 were used (pickled pelt of 1000 g, sammed to 600 g, subsequent absorption of 400 g of tanning solution, 30 bar and 40° C. for 2 hours). Tanning took place under nitrogen instead of carbon dioxide. Haptic and visual checking revealed good quality of leather. This was confirmed by the shrinkage test (TS>90° C.).

EXAMPLE 8

A tanning with vegetable tanning agent was performed for cattle hide and goat hide. 1 kg of hide were used in each case.

No samming, but tanning with float. Based on the hide weight, 2.5% by weight of Picaltal flakes (as salt substitute), 15% of vegetable tanning agent (tara) and 500% of water were added. The pH was raised to 4.0. Process parameters were set to 200 bar, 40° C. and 10 revolutions per minute. A high quality of leather was obtained after a process time of 4 h. The leathers were examined using shrinkage temperature ($T_{Svegetable}$>70° C.), visual and haptic analysis.

EXAMPLE 9

A raw hide (pickled pelt from the cow) having a weight of 1000 g was mechanically sammed. Hide weight after this operation was 600 g. The hide was then contacted with 400 g of tanning solution. Sufficient chromium sulphate was dissolved in this tanning solution for 10.06 g of chromium(III) ions to be present. This corresponded to 1.05 times the target value of 4% of chromium oxide in the leather, which was chosen as guideline value for obtaining good quality of leather. After the hide had imbibed the tanning solution, it was treated with carbon dioxide in an autoclave at 60 bar and 40° C. for 3 h. The basket holding the hide rotated at 10 revolutions per minute. Immediately after letting off the pressure and opening the autoclave, a shrinkage temperature of 99° C. was measured. When the tanned cattle hide leather was contacted with boiling water, the latter remained totally clear, which is considered to be evidence that neither chromium nor proteins are boiled out of the hide.

The remaining piece of hide was subsequently finished. The shrinkage temperature of the finished piece rose to 100° C. Again no discoloration of the boiling water was observed. The remaining quality parameters were comparable to Example 1 and evidenced a very high quality on the part of the tanned leather.

The invention claimed is:

1. A process for tanning animal hides comprising:

bating and pickling the animal hide in aqueous solution;

reducing liquid content of the animal hide by 5% to 90% by weight;

replacing at least some of the liquid content removed from the animal hide in the preceding step by a tanning solution such that the float ratio, which is defined as $$\frac{\text{mass of tanning solution}}{\text{mass of the animal hide fully saturated with the aqueous solution which are to be tanned}}$$

has a value of from 0.05 to less than 1, wherein the tanning solution comprises a tanning agent, the amount of the tanning agent approximately corresponds to the amount to be imbibed by the animal hide to an amount not more than 80% in excess of the amount to be imbibed by the animal hide; and treating the animal hide having the tanning solution with compressed gas in a pressurized container for a period of at least 15 minutes.

2. The process according to claim 1, wherein the reducing step removes from 20% to 70% of the liquid content of the animal hide.

3. The process according to claim 1, wherein the replacing step is effected such that the float ratio is in a range from 0.05 to 0.9.

4. The process according to claim 1, wherein the pressurized-treatment period is from 30 minutes to 30 hours.

5. The process according to claim 1, wherein the compressed gas is selected from the group consisting of carbon dioxide, nitrogen, and combinations thereof.

6. The process according to claim 1, wherein the pressure in the treating step is in the range from 10 bar to 200 bar.

7. The process according to claim 1, wherein the temperature in the treating step is in the range from 0 degrees Celsius to 80 degrees Celsius.

8. The process according to claim 1, wherein the tanning solution further comprises an agent selected from the group consisting of vegetable tanning agents, synthetic tanning agents, and combinations thereof.

9. The process according to claim 8, wherein the tanning solution comprises tanning agents comprising metal cations.

10. The process according to claim 1, wherein the tanning solution further comprises at least one substance selected from the group consisting of dyes, adhesives, moisture-regulating preparations, flame retardants, microparticles, nanoparticles, emulsifiers, emulsions, hydrophobicizers, lipophilizers, brighteners, fats, train oils, oils, and combinations thereof.

11. The process according to claim 1, wherein the tanning solution comprises the tanning agent to be imbibed by the animal hide in an excess of at most 20%.

12. The process according to claim 1, wherein the bating and pickling step is effected in a pressurized container in a presence of a compressed gas.

13. The process according to claim 1, wherein the process is fully wastewaterless.

* * * * *